US006926598B2

(12) United States Patent
Toge et al.

(10) Patent No.: US 6,926,598 B2
(45) Date of Patent: Aug. 9, 2005

(54) GRINDING WHEEL

(75) Inventors: Naoki Toge, Fukuoka-ken (JP); Yasuaki Inoue, Fukuoka-ken (JP)

(73) Assignees: Noritake Super Abrasive Co., Ltd., Fukuoka-ken (JP); Noritake Co., Limited, Nagoya (JP)

( * ) Notice: Subject to any disclaimer, the term of this patent is extended or adjusted under 35 U.S.C. 154(b) by 53 days.

(21) Appl. No.: 10/626,554

(22) Filed: Jul. 25, 2003

(65) Prior Publication Data

US 2004/0198206 A1 Oct. 7, 2004

(30) Foreign Application Priority Data

Mar. 28, 2003 (JP) ..... 2003-090773

(51) Int. Cl.[7] ..... B24B 33/00
(52) U.S. Cl. ..... 451/540; 451/548
(58) Field of Search ..... 451/540, 548, 451/541, 546

(56) References Cited

U.S. PATENT DOCUMENTS

| | | | | | |
|---|---|---|---|---|---|
| 2,826,015 | A | * | 3/1958 | Osenberg | 451/527 |
| 3,117,400 | A | * | 1/1964 | Martin | 451/548 |
| 3,716,951 | A | * | 2/1973 | Walters | 451/548 |
| 5,052,153 | A | * | 10/1991 | Wiand | 451/70 |
| 5,092,083 | A | * | 3/1992 | Raffaelli | 451/541 |
| 5,885,149 | A | * | 3/1999 | Gillet et al. | 451/546 |
| 6,620,522 | B2 | * | 9/2003 | Kusachi et al. | 428/551 |

FOREIGN PATENT DOCUMENTS

| | | |
|---|---|---|
| JP | 2000-233373 | 8/2000 |
| JP | 2001-62734 | 3/2001 |
| JP | 2001-79772 | 3/2001 |
| JP | 2002-126997 | 5/2002 |
| JP | 2002-144244 | 5/2002 |
| JP | 2002-187065 | 7/2002 |
| JP | 2002-210659 | 7/2002 |
| JP | 2002-263937 | 9/2002 |
| JP | 2002-273657 | 9/2002 |
| JP | 2003-053673 | 2/2003 |
| JP | 2003-71717 | 3/2003 |
| JP | 2003-283218 | 10/2003 |

* cited by examiner

*Primary Examiner*—Eileen P. Morgan
(74) *Attorney, Agent, or Firm*—Wenderoth, Lind & Ponack, L.L.P.

(57) ABSTRACT

A grinding wheel having a tool portion formed by firmly fixing diamond grains to an end face of a cup-shaped core by brazing. A circumferentially continuous groove is formed in a substantially central portion of the end face of the core. The abrasive grains are firmly fixed to an end face portion excluding regions near an outer rim and near an inner rim of the end face and near the boundaries with the groove under the condition that, with respect to all the abrasive grains, skirts of a brazing material layer for holding the abrasive grains have a length one or more times an average grain size of the abrasive grains. The provision of the groove in the end face of the core can enhance the capability of ejecting chips that occur during machining; besides, chips can be captured in the groove to preclude the occurrence of scratches resulting from the chips. Moreover, sufficient lengths of skirts of the brazing material layer are secured for all the abrasive grains arranged on the end face of the core, which improves the force for holding the abrasive grains and avoids grain fall-out during machining.

7 Claims, 4 Drawing Sheets

GRINDING WHEEL

BACKGROUND OF THE INVENTION

1. Field of the Invention

The present invention relates to a cup-shaped grinding wheel for use in machining a machine part made of an aluminum die-cast alloy, cast iron, or the like, and a cup-shaped grinding wheel for use in dressing a polishing pad at the time of CMP processing on a semiconductor wafer.

2. Description of the Related Art

Diamond tools are often used in machining aluminum die-cast alloys, cast iron, etc. Such machining requires high machining efficiency and favorable work surface roughness with fewer scratches.

An example of milling tools fabricated to achieve high machining efficiency is described in Unexamined Japanese Patent Publication No. 2001-79772.

The milling tool described in Unexamined Japanese Patent Publication No. 2001-79772 is a milling tool having an abrasive grain layer, or a tool portion, formed by brazing diamond grains to an end face of a cup-shaped core and an outer periphery thereof. An inclined portion or a curved portion is formed on a part of the end face of the core closer to the outer periphery. The outer periphery of the core and the inclined portion or curved portion of the end face of the core serves as a region for coarse grinding. Abrasive grains are arranged under a condition appropriate for coarse grinding, and a flat part of the end face of the core serves as a region for grinding, abrasive grains are arranged under a condition appropriate for grinding. According to this milling tool, the abrasive grain layer is divided into the region for coarse grinding and the region for grinding, and is provided with abrasive grains under respective appropriate conditions, so that the processing of both coarse grinding and grinding can be performed with the single tool simultaneously for improved machining efficiency.

Meanwhile, dressers for CMP processing often use a dresser having diamond grains firmly fixed to a base. This dresser requires high sharpness and fewer occurrences of wafer scratches resulting from grain cracks and fall-out.

Examples of the dresser for CMP processing having favorable sharpness with less grain cracks and fall-out are described in Unexamined Japanese Patent Publications Nos. 2002-273657 and 2002-126997.

The dresser for CMP processing described in Unexamined Japanese Patent Publication No. 2002-273657 is a dresser for CMP processing in which abrasive grains are firmly fixed to the surface of the base by brazing, with particular crystalline surfaces of these abrasive grains arranged in a certain direction. According to this dresser for CMP processing, the firm fixing of the abrasive grains by brazing provides high sharpness, and the mutual alignment of the directions of the crystalline surfaces of the abrasive grains with each other can suppress the occurrence of grain cracks during dressing.

Moreover, the dresser for CMP processing described in Unexamined Japanese Patent Publication No. 2002-126997 is a dresser for CMP processing in which abrasive grains are firmly fixed to the surface of the base by brazing, and a coating layer comprising glass, as an essential component, having a certain range of coefficients of thermal expansion is applied to the surface of this brazing material layer. According to this dresser for CMP processing, favorable sharpness is provided while erosion of the brazing material layer and the base metal by the abrasive for CMP processing disappears to avoid grain fall-out.

Although the milling tool set forth in Unexamined Japanese Patent Publication No. 2001-79772 and the dresser for CMP processing set forth in Unexamined Japanese Patent Publication No. 2002-273857 described above have favorable grinding capability, they have a problem in terms of grain fall-out. When grain fall-out occurs during grinding, the grain chips move over the surface of the substance to be ground as if dragged around, with the result that there appear big scratches. The timing of the occurrence of scratches resulting from grain fall-out is difficult to predict, and the occurrence of scratches can only be avoided by replacing the grinding wheel earlier to preclude grain fall-out. As a result, the wheel life becomes shorter, which increases the cost of the grinding wheel.

The inventors have made an intensive study of the grain fall-out phenomenon during grinding in the grinding wheel having abrasive grains firmly fixed to the end face of its cup-shaped core by brazing, and confirmed that grain fall-out tends to occur in the outermost peripheral region and innermost peripheral region of the core end face, i.e., in the vicinities of corners. Abrasive grains arranged near the outer peripheral corner of the core end face are apt to fall-out during machining since the brazing material layer formed on the core end face on the outer peripheral side of the abrasive grains has shorter skirts and the brazing material fails to provide sufficient force for holding the abrasive grains. Similarly, the abrasive grains arranged near the inner peripheral corner of the core end face are also apt to fall-out since the brazing material on the inner peripheral side of the core end face provides insufficient force for holding the abrasive grains.

Conventional cup-shaped grinding wheels have not devised a countermeasure against grain fall-out with particular emphasis on the outermost peripheral region and innermost peripheral region of the core end face. The conventional wheels were designed with a principle objective of avoiding grain fall-out over the entire abrasive grain layer, and it has thus been difficult to prevent grain fall-out with a high degree of reliability.

Meanwhile, the dresser for CMP processing set forth in Unexamined Japanese Patent Publication No. 2002-126997 is an effective means in terms of the prevention of grain fall-out, whereas there is the problem that the application of the additional coating layer to the surface of the brazing material layer decreases the heights of protrusion of the abrasive grains accordingly with a drop in sharpness, and shrinks chip pockets between abrasive grains with a drop in the capability of ejecting chips.

The present invention has been achieved in order to solve such problems, and it is thus an object thereof to provide a grinding wheel which can preclude the occurrence of scratches resulting from grain fall-out to obtain a favorable work surface.

SUMMARY OF THE INVENTION

A grinding wheel of the present invention is a grinding wheel comprising an abrasive grain layer formed by Firmly fixing abrasive grains to an end face of a cup-shaped core by brazing. A circumferentially continuous groove is formed in a substantially central portion of the end face of the core, and the abrasive grains are firmly fixed to an end face portion excluding regions near an outer rim and near an inner rim of the end face and near a boundary with the groove under the condition that, with respect to all the abrasive grains, skirts of a brazing material layer for holding the abrasive grains have a length one or more times an average grain size of the abrasive grains.

The provision of the circumferentially continuous groove in the substantially central portion of the end face of the core can enhance the capability of ejecting chips generated during machining. Moreover, chips are captured into the groove, thereby precluding the occurrence of scratches resulting from the chips. Here, the groove preferably has a substantially rectangular or substantially V-shaped section, with the bottom corners being rounded. As for groove size, although depending on the material of the substance to be ground and the breadth of the grain layout regions, the width of the groove is preferably greater than the length of chips. In numeric terms, the width of the groove preferably falls within the range from 2 to 15 mm or so.

Now, the abrasive grains are not arranged on the regions near the outer rim and near the inner rim of the end face and near the boundary with the groove, but are firmly fixed on the end face portion excluding these regions under the condition that, with respect to all the abrasive grains, the skirts of the brazing material layer for holding the abrasive grains have a length one or more times the average grain size of the abrasive grains. Thus, since the brazing material layer surrounds the abrasive grains, the grain holding force improves and grain fall-out can be avoided during machining. Here, the length of the skirts of the brazing material layer indicates the degree of spread of the brazing material layer around the abrasive grains. For the abrasive grains arranged on the outermost periphery of the portion for abrasive grains to be arranged, as shown in an enlarged partial view of FIG. 3, the length refers to a horizontal distance L from a bonding boundary point 18 between an abrasive grain 12 and a brazing material layer 17 to the endpoint 19 of the skirt of the brazing material layer 17. At a portion, if any, where this skirt length is smaller than the average grain size of the abrasive grains, fall-out can easily occur due to insufficient force for holding the abrasive grains. When the skirt length of the brazing material layer is rendered excessively large, portions of the regions near the outer rim and near the inner rim of the end face and near the boundary with the groove, where no abrasive grain is arranged, increase in area, the abrasive grains arranged on the end face decrease in number, and the load on each individual abrasive grain increases with a drop in sharpness. Therefore, the skirt length of the brazing material layer is preferably within three times the grain size of the abrasive grains.

The interval of arrangement of the individual abrasive grains is preferably two to three times the average grain size of the abrasive grains. When the abrasive grains are arranged at such intervals, chip pockets can be secured with reliability, so that abrasive grains, even in case of fall-out, can be ejected through these chip pockets to preclude the occurrence of scratches resulting from the grain chips. When the grain interval is narrower than twice the average grain size of the abrasive grains, it becomes difficult to eject grain chips. When the grain interval is widened beyond three times the average grain size of the abrasive grains, the work surface roughness of the substance to be ground becomes unfavorably high.

Moreover, the thickness of the brazing material at the shallowest portions of the brazing material layer between adjoining abrasive grains is preferably ⅓ to ½ the average grain size of the abrasive grains. When the minimum thickness of the brazing material layer between abrasive grains is below ⅓ the average grain size of the abrasive grains, the grain holding force becomes smaller. Above ½ the chip pockets become smaller. The range mentioned above is thus preferable.

The circumferentially continuous groove is formed in the substantially central portion of the end face of the core, and thereby the abrasive grain layer is divided into two, the inside region and outside region of this groove. Here, the grain size and the interval of arrangement of the abrasive grains may be changed between the inside region and the outside region for functional segregation in that the outside region is for coarse grinding and the inside region is for finish grinding. In this case, the height of the extremities of the grains on the inside region can be made higher than the height of the extremities of the grains on the outside region to improve the work surface roughness of the substance to be ground. Besides, when the inside region and the outside region are provided with gradients on their respective outer portions, it is possible to ease load concentration on the abrasive grains arranged on the outer portions.

Furthermore, flat portions may be formed on the extremities of the abrasive grains on the inside region. These flat portions on the extremities of the abrasive grains can be formed by cutting off the tops of the abrasive grains with a diamond truer. The amount of the tops of the abrasive grains to be cut off and the areas of the flat portions can be adjusted by the total depth of cut of the diamond truer. The amount of the tops of the abrasive grains to be cut off is preferably 5–30% the average grain size of the abrasive grains, and the work surface roughness significantly improves if the amount of cut-off falls within this range. When the amount of cut-off is below 5% the average grain size of the abrasive grains, the effect of improving the surface roughness is hard to obtain. Above 30%, the resistance at the time of grinding increases to lower the sharpness.

DETAILED DESCRIPTION OF THE PREFERRED EMBODIMENT

Hereinafter, the grinding wheel of the present invention will be described based on an embodiment thereof.

Figure 1:
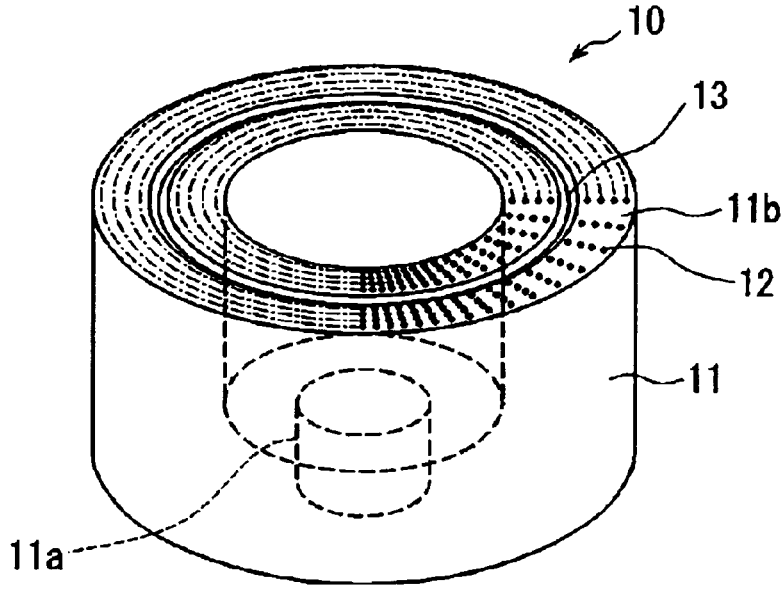
FIG. 1 is a perspective view showing a grinding wheel according to an embodiment of the present invention.
Figure 2:
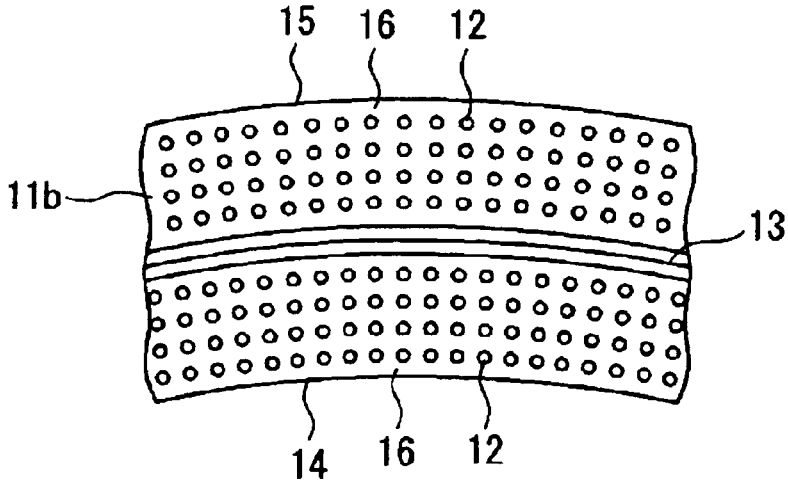
FIG. 2 is an enlarged view of an abrasive grain layer of the tool of the grinding wheel.
Figure 3:
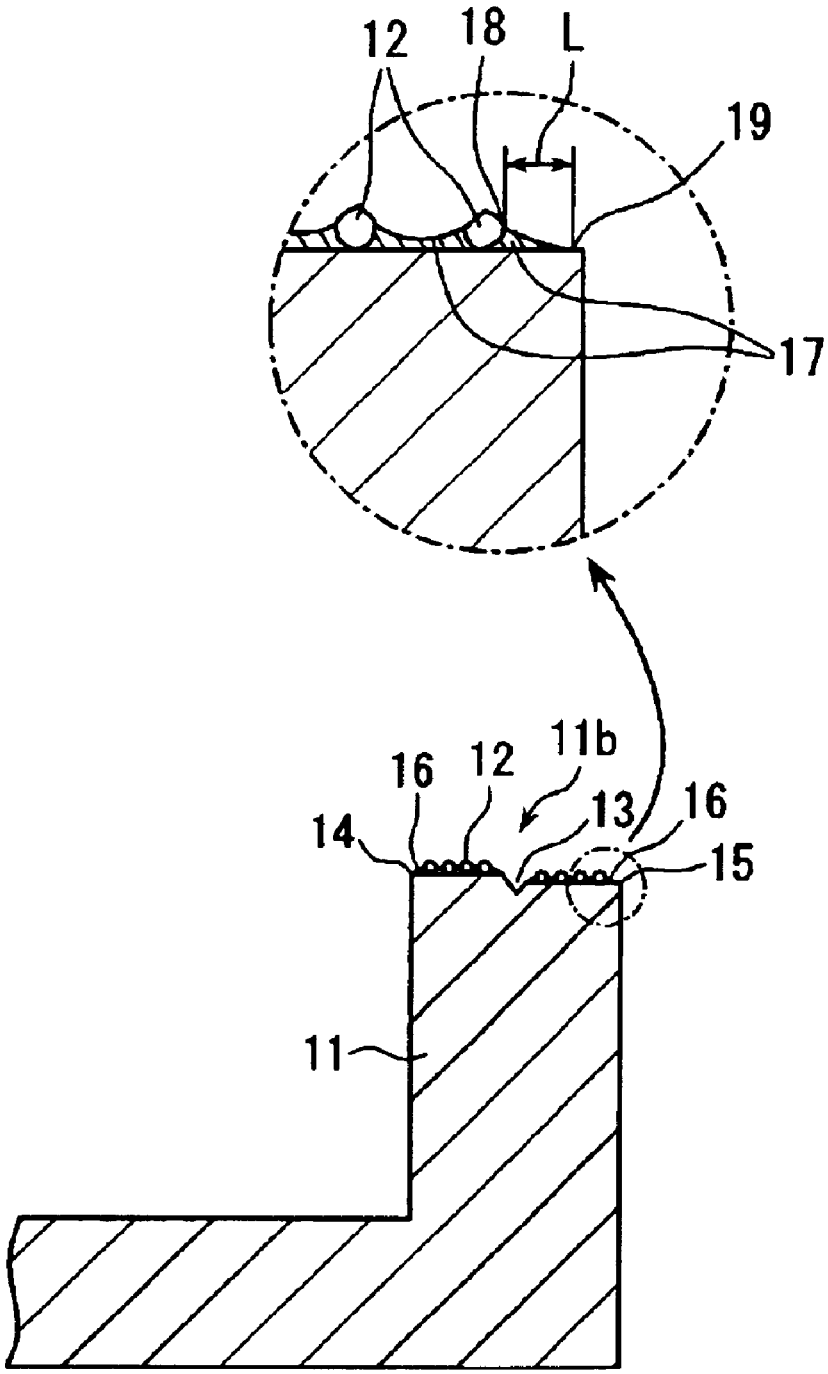
FIG. 3 is an enlarged sectional view of the tool portion.

FIGS. 1 to 3 show the configuration of the grinding wheel according to an embodiment of the present invention.

FIG. 1 is a perspective view showing the grinding wheel according to the embodiment of the present invention, FIG. 2 is an enlarged view of an abrasive grain layer of this grinding wheel, and FIG. 3 is an enlarged sectional view of a tool portion.

In FIG. 1, the grinding wheel 10 has a tool portion formed by firmly fixing diamond abrasive grains 12 to an end face of a cylindrical core 11 by brazing.

The core 11 is a steel core having an overall configuration of short cylindrical shape, and a mounting hole 11*a* for mounting the core to a rotating spindle of a processing machine is formed in the center of the bottom thereof.

As shown in FIGS. 2 and 3, the abrasive grains 12 are aligned and firmly fixed to an end face 11*b* of the core 11, and a circumferentially continuous V-sectioned groove 13 is formed in a substantially central portion of the end face 11*b*. The abrasive grains 12 are firmly fixed to the end face 11*b* excluding the groove 13, over an end face portion excluding regions near an outer rim 15, near an inner rim 14, and near the boundaries with the groove 13 under the condition that, with respect to all the abrasive grains 12, skirts of the brazing material layer for holding the abrasive grains 12 have a length L one or more times an average grain size of the abrasive grains. In this grinding wheel 10, it is of particular importance in view of avoiding grain fall-out that the region near the inner rim 14 and the region near the outer rim 15 of the end face 11*b* are regions 16 where the brazing material layer alone is formed with no abrasive grains 12 arranged. In conventional grinding wheels, abrasive grains have been arranged even in the vicinity of the outer rim and in the vicinity of the inner rim of the end face, and the grain holding forces on these abrasive grains from the brazing material layer have thus been insufficient, which has facilitated grain fall-out during machining. On the other hand, in the grinding wheel 10 of the present embodiment, the abrasive grains 12 are excluded not only from the vicinities of the boundaries with the groove 13 but also from the region near the inner rim 14 and the region near the outer rim 15 of the end face 11*b* to secure sufficient grain holding forces of the brazing material layer for all the arranged abrasive grains, so that grain fall-out is avoided during machining.

Embodiment 1

A grinding wheel having a tool portion of the configuration shown in FIG. 3 (invention 1) on the end face of a cup-shaped core of 100 mm in outer diameter was fabricated. For comparison, a grinding wheel of the same core configuration, with a tool portion having the configuration described in Unexamined Japanese Patent Publication No. 2001-79772 (comparative article 1) was fabricated, and a comparative test on grinding capability was conducted.

Diamond grains having an average grain size of 400 $\mu$m were used as the abrasive grains, which were systematically arranged at intervals of 800 $\mu$m. Brazing material containing active metal was used as a fixing agent, and the thickness of the brazing material layer around the abrasive grains was approximately 200 $\mu$m.

In the case of the invention 1, the abrasive grains were excluded from the regions near the outer rim and near the inner rim of the core end face and near the boundaries with the groove, and the regions having brazing material alone were 600 $\mu$m in width.

The grinding wheels of the invention 1 and the comparative article 1 described above were wet ground under the following grinding conditions.

Substance to be ground: aluminum die-cast alloy ADC-14

Grinding machine: machining center

Spindle rotation speed: 5000 $min^{-1}$

Depth of cut: 0.3 mm/pass

Feed speed: 2000 mm/min

The invention 1 and the comparative article 1 were investigated for the areas machined by the foregoing grinding before the surface roughness of the substance to be ground deteriorated. Table 1 shows the results.

TABLE 1

| | Power consumption | Life (machined area) | Surface roughness (Maximum height of profile Rz) |
|---|---|---|---|
| Invention 1 | 100 | 300 | 3.5 $\mu$m |
| Comparative article 1 | 100 | 100 | 10 $\mu$m |

Notes: The power consumption and the life are shown as indices with those of the comparative article 1 as 100.

Rz is by definition of JIS (Japanese Industrial Standards) B0601-2001.

In the comparative article 1, grain fall-out occurred at the corners of the core end face and the maximum height of profile Rz exceeded 10 $\mu$m, at which time it was called life. In contrast, the invention 1 maintained the maximum height of profile Rz to or below 3.5 mm even when the machined area reached or exceeded three times that of the comparative article 1.

These results confirmed that the tool configuration of the present invention can avoid the occurrence of scratches resulting from grain fall-out, allowing an improvement in life and the maintenance of favorable surface roughness.

Figure 4:
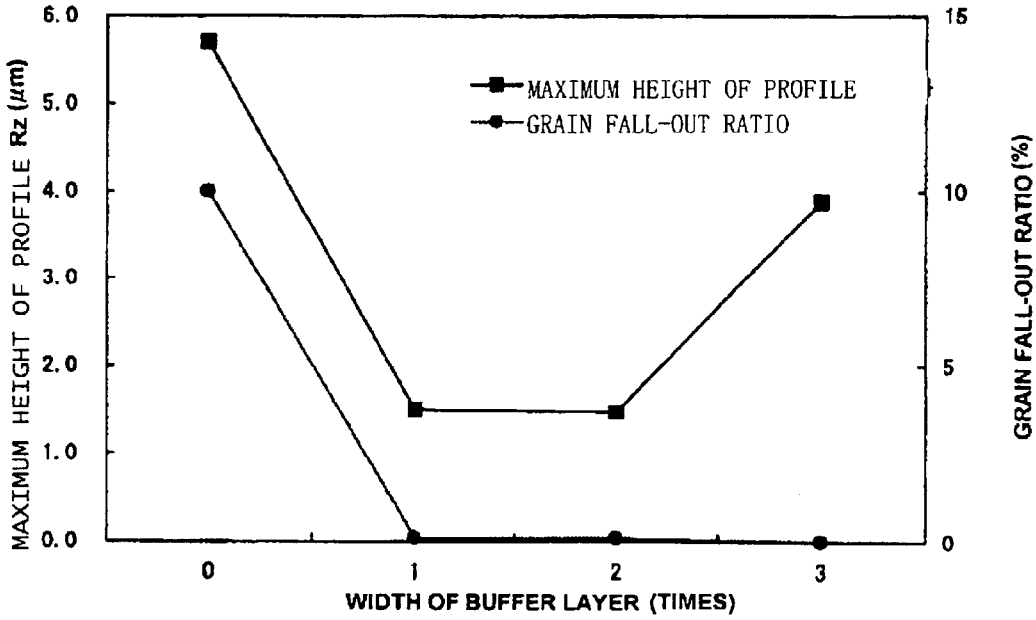
FIG. 4 is a chart showing the results of a grinding test.

FIG. 4 shows grain fall-out ratio and maximum height of profile Rz when the width of the region provided with no abrasive grains (for convenience, hereinafter referred to as a buffer layer) in each of the regions near the outer rim and near the inner rim of the core end face and near the boundaries with the groove is changed within the range from zero to three times the average grain size of the abrasive grains. The abscissa of FIG. 4 shows how many times the width of the buffer layer is with respect to the average grain size of the abrasive grains. As can be seen from the chart, grain fall-out significantly decreases and favorable work surface roughness is maintained when the width of the buffer layer, which is provided with no abrasive grain, is in the range from one to three times the average grain size of the abrasive grains.

Figure 5:
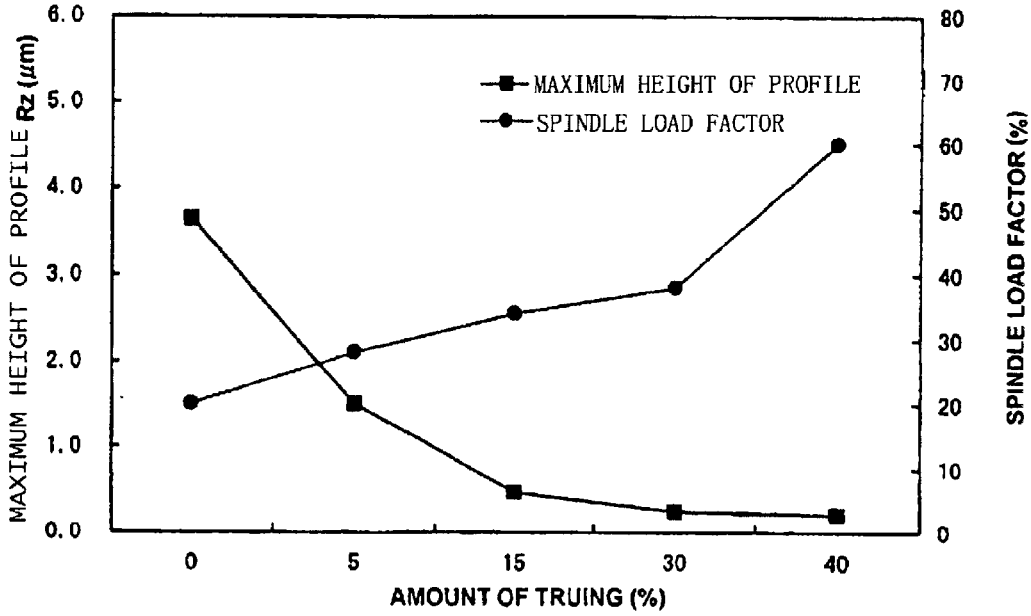
FIG. 5 is a chart showing the results of a grinding test.

FIG. 5 shows maximum height of profile Rz and the spindle load factor of the grinding machine when the amount of truing (the amount of cut-off) is changed in forming flat portions on the extremities of the abrasive grains on the inside region. The abscissa of FIG. 5 shows the ratio of the amount of truing to the average grain size of the abrasive grains.

As can be seen from FIG. 5, when the amount of truing is set at 5–30% the average grain size of the abrasive grains, it is possible to obtain favorable surface roughness and ease the spindle load factor of the grinding machine.

Embodiment 2

Figure 6:
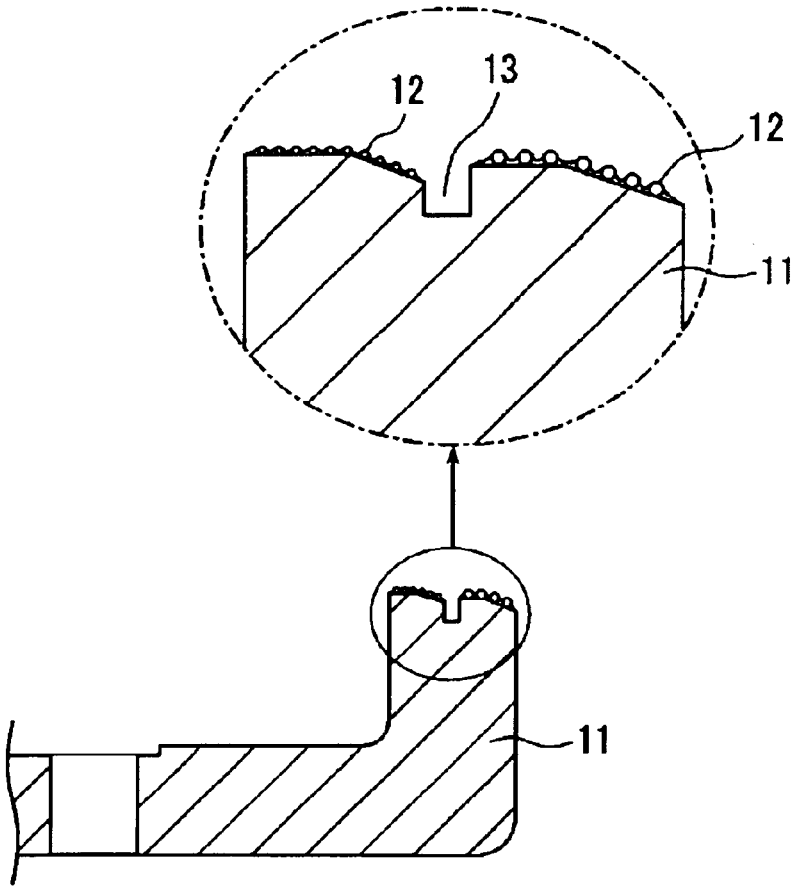
FIG. 6 is a diagram showing the configuration of the tool portion of a wheel used in the grinding test.

A grinding wheel having a tool portion of the configuration shown in FIG. 6 (invention 2) on the end face of a cup-shaped core of 100 mm in outer diameter was fabricated. For comparison, a grinding wheel of the same core configuration, with a tool portion having the configuration described in Unexamined Japanese Patent Publication No. 2001-79772 (comparative article 2) was fabricated, and a comparative test on grinding capability was conducted.

In the case of the invention 2, the groove 13 in the central portion was an 11-mm-wide groove having a rectangular section. Fine diamond grains 12 (average grain size of 200 $\mu$m) were arranged on a 5.5-mm-wide inside region under the condition of 600 $\mu$m in grain interval, 120 $\mu$m in the thickness of the brazing material around the abrasive grains, and 350 $\mu$m in the width of the buffer layer. Moreover, the extremities of the abrasive grains were trued into flat portions for finish grinding. Coarse diamond grains 12 (average grain size of 400 μm) were arranged on a 5.5-mm-wide outside region for coarse grinding under the condition of 900 μm in grain interval, 200 μm in the thickness of the brazing material around the abrasive grains, and 900 μm in the width of the buffer layer.

The grinding wheels of the invention 2 and the comparative article 2 described above were wet ground under the same condition as the grinding condition of the embodiment 1 except that the substance to be ground was a composite material of an aluminum die-case alloy and cast iron.

As a result of the grinding, the comparative article 2 showed the same result as that of the comparative article 1 in the embodiment 1, while the invention 2 showed no grain fall-out nor occurrence of scratches. Besides, chips produced during machining were captured in the center groove to preclude chip bites, achieving a maximum height of profile Rz of 3 μm or less.

Embodiment 3

Figure 7:
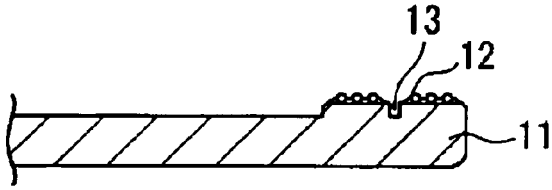
FIG. 7 is a diagram showing the configuration of the tool portion of another wheel used in the grinding test.

A dresser for CMP processing having a tool portion of the configuration shown in FIG. 7 (invention 3) on the end face of a cup-shaped core of 100 mm in outer diameter was fabricated. For comparison, a dresser for CMP having the same core configuration with abrasive grains arranged all over the end face (comparative article 3) was fabricated. A semiconductor-wafer CMP processing test was conducted while the polishing pad was being dressed by these dressers.

In the invention 3, the groove 13 in the central portion was a 2-mm-wide groove having a rectangular section. The diamond grains 12 of 200 μm in average grain size were arranged on the inside region and the outside region under the condition of 750 μm in grain interval and 300 μm in the width of the buffer layers.

The dressers of the invention 3 and the comparative article 3 described above were attached to a CMP machine, and semiconductor wafers were processed by CMP while the polishing pad was being dressed by these dressers. The machining condition included dresser rotation speed: 100 $min^{-1}$, table rotation speed: 100 $min^{-1}$, machining load: 44N, wafer dimensions: 40×40 mm, and machining time: 5 hours.

As a result of the test, the comparative article 3 showed grain fall-out at the outer rim of the core end face in machining the second wafer, leaving big scratches on the wafer. Four big scratches occurred in the first 30 minutes, then gradually decreased to one for 30 minutes between the first two to three hours, and disappeared after the first three hours. On the contrary, the invention 3 was free of grain fall-out, without any scratch on the wafers, and showed a stable polishing-pad chipping rate. Besides, chips produced during machining were captured in the groove in the central portion to preclude chip bites.

While there has been described what is at present considered to be a preferred embodiment of the invention, it will be understood that various modifications can be made thereto, and it is intended that the appended claims cover all such modifications as fall within the true spirit and scope of the invention.

What is claimed is:

1. A grinding wheel comprising:

a cup-shaped core having an end face delimited by an outer peripheral rim and an inner peripheral rim;

an abrasive grain layer formed of abrasive grains firmly fixed to said end face of said cup-shaped core by brazing such that the abrasive grains are fixed to said end face by a brazing material layer; and a continuous groove formed in a substantially central portion of said end face of said cup-shaped core so as to define an outer surface region and an inner surface region, wherein said abrasive grains are firmly fixed to the inner and outer surface regions of said end face by the brazing material layer excluding outer and inner circumferential portions of both of the inner and outer surface regions, wherein, with respect to all of the abrasive grains, skirts of the brazing material layer have a length of one or more times an average grain size of the abrasive grains.

2. The grinding wheel according to claim 1, wherein the size of the abrasive grains in the outer surface region is different than the size of the abrasive grains in the inner surface region such that the outer surface region is adapted for coarse grinding and the inner surface region is adapted for finish grinding.

3. The grinding wheel according to claim 2, wherein the spacing of the abrasive grains in the outer surface region is different than the spacing of the abrasive grains in the inner surface region.

4. The grinding wheel according to claim 1, wherein the spacing of the abrasive grains in the outer surface region is different than the spacing of the abrasive grains in the inner surface region.

5. The grinding wheel according to claim 2, wherein flat portions are formed on extremities of said abrasive grains in the inner surface region.

6. The grinding wheel according to claim 3, wherein flat portions are formed on extremities of said abrasive grains in the inner surface region.

7. The grinding wheel according to claim 4, wherein flat portions are formed on extremities of said abrasive grains in the inner surface region.

* * * * *